US008214973B2

(12) United States Patent
Salice

(10) Patent No.: US 8,214,973 B2
(45) Date of Patent: Jul. 10, 2012

(54) FURNITURE HINGE

(75) Inventor: Luciano Salice, Carimate (IT)

(73) Assignee: Arturo Salice S.p.A., Novedrate (IT)

( * ) Notice: Subject to any disclaimer, the term of this patent is extended or adjusted under 35 U.S.C. 154(b) by 55 days.

(21) Appl. No.: 12/922,843

(22) PCT Filed: Feb. 5, 2009

(86) PCT No.: PCT/EP2009/000786

§ 371 (c)(1),
(2), (4) Date: Sep. 15, 2010

(87) PCT Pub. No.: WO2009/115170

PCT Pub. Date: Sep. 24, 2009

(65) Prior Publication Data

US 2011/0005035 A1 Jan. 13, 2011

(30) Foreign Application Priority Data

Mar. 19, 2008 (IT) ..... MI2008A0467

(51) Int. Cl.
*E05D 7/00* (2006.01)

(52) U.S. Cl. ..... 16/286; 16/54; 16/288; 16/284

(58) Field of Classification Search ..... 16/286–288, 16/50, 54, 56, 82, 294, 387, 262, DIG. 21; 188/268, 271, 290, 291, 296, 322.5, 281, 188/282.5, 282.8, 282.9
See application file for complete search history.

(56) References Cited

U.S. PATENT DOCUMENTS

| | | | | | |
|---|---|---|---|---|---|
| 4,226,001 | A * | 10/1980 | Salice | ..... | 16/294 |
| 4,543,686 | A * | 10/1985 | Rock et al. | ..... | 16/288 |
| 4,654,930 | A * | 4/1987 | Lautenschlager et al. | ..... | 16/288 |
| 4,894,884 | A | 1/1990 | Lautenschlager, Jr. | | |
| 5,008,977 | A * | 4/1991 | Lautenschlager et al. | ..... | 16/278 |
| 5,022,117 | A * | 6/1991 | Lautenschlager et al. | ..... | 16/288 |
| 6,601,267 | B2 * | 8/2003 | Salice | ..... | 16/287 |
| 7,127,778 | B2 * | 10/2006 | Salice | ..... | 16/354 |
| 2004/0226139 | A1 * | 11/2004 | Salice | ..... | 16/286 |

FOREIGN PATENT DOCUMENTS

| | | | |
|---|---|---|---|
| DE | 3808585 | A1 | 9/1989 |
| EP | 1477628 | A | 11/2004 |
| WO | WO2006/051074 | A | 5/2006 |

OTHER PUBLICATIONS

International Search Report and Written Opinion from International Application No. PCT/EP2009/000786 mailed Apr. 16, 2009.

* cited by examiner

*Primary Examiner* — Chuck Y. Mah
(74) *Attorney, Agent, or Firm* — Fitch, Even, Tabin & Flannery, LLP

(57) ABSTRACT

A furniture hinge has a first and a second equalizers connecting to a box-shaped body and a hinge arm, the first equalizer being pivoted to the box-shaped body through a first pin and to the hinge arm through a second pin, the second equalizer being pivoted to the box-shaped body through a third pin and to the hinge arm through a fourth pin, a flexure spring being wound around a pin fixed to the hinge arm and having a first spring arm abutting against the hinge arm and a second spring arm abutting against a control cam formed on the first equalizer, a contact surface between the control cam and the second spring arm, during the rotation or the hinge the contact surface moving along both the profile of the control cam and the profile of the second spring arm.

7 Claims, 2 Drawing Sheets

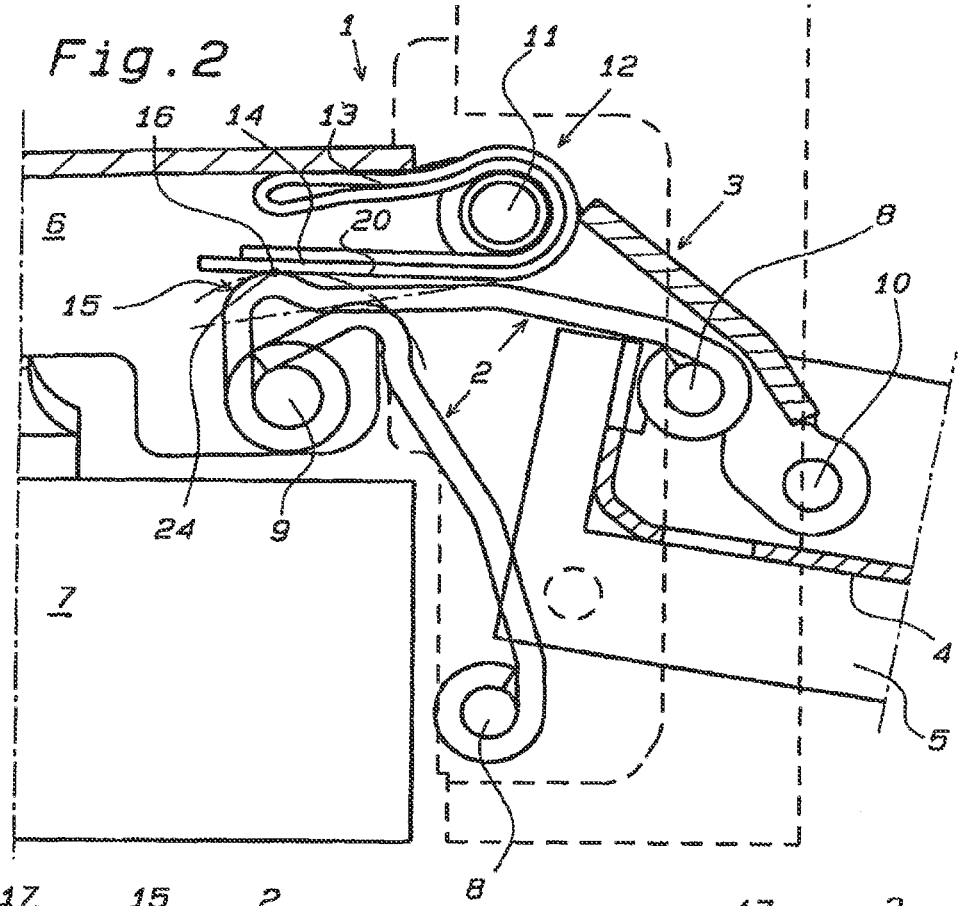
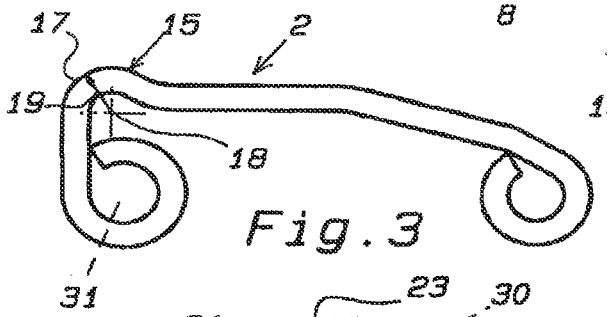
Fig.3
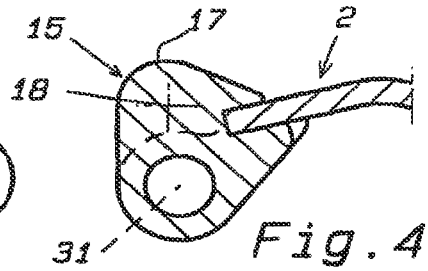
Fig.4
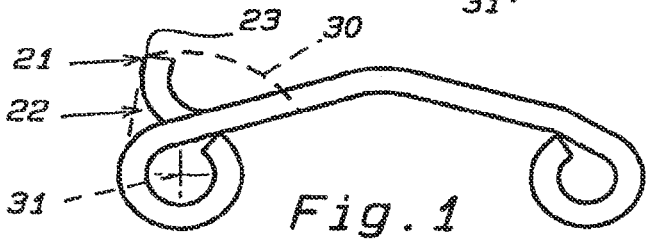
Fig.1
(Prior Art)

FURNITURE HINGE

CROSS REFERENCE TO RELATED APPLICATIONS

This application is a U.S. national phase application of International Application No. PCT/EP2009/000786, filed Feb. 5, 2009, which claims benefit from Italian Application No. MI2008A000467, filed Mar. 19, 2008, both of which are hereby incorporated herein by reference in their entirety.

BACKGROUND OF THE INVENTION

The present invention refers to a furniture hinge of the type comprising a hinge arm adapted to be fixed directly or indirectly onto a fixed element of the furniture and a box-shaped element adapted to be fixed onto a door of the furniture, and a first and a second equaliser connecting the box-shaped body and the arm operatively to each other defining an articulated quadrilateral therewith.

Such hinges usually have springs of various types for creating a closure and/or opening restoring force of the doors on which they are applied.

In a currently common embodiment, the restoring spring, of the flexure type, is peripherally wound around a hinging pin of the second equaliser, to the hinge arm and has a first arm abutting against the hinge arm a second arm abutting against a control cam present on the first equaliser.

Hinges of the abovementioned type with a closure restoring force on the door usually require a considerable effort to open the door during an angular excursion of the same, such excursion being extremely limited starting from its closed position.

This leads to an excessive mechanical stress on the spring, due to the fact the second spring arm is subjected to a large camber during most of the opening movement of the hinge and it can have a noticeable opposite camber during the last opening arc of the hinge before reaching the maximum opening of the door.

All this gives rise to an intense stress caused by mechanical fatigue of the spring jeopardising its structural integrity within a short period of time.

Therefore, the technical task of the present invention is that of providing a furniture hinge capable of eliminating the technical drawbacks observed in the known art.

SUMMARY OF THE INVENTION

In the scope of this technical task, an object of the invention is that of providing a furniture hinge capable of allowing the opening of a door with a limited effort, though maintaining a good restoring force of the door when closing.

Another object of the invention is that of providing a furniture hinge which is mechanically extremely resistant, and capable of maximally limiting the mechanical fatigue stress to which the restoring spring is subjected.

Last but not least, an object of the invention is that of providing a furniture hinge which is strong, long-lasting and accurate in its operation, as well as being inexpensive.

The technical task, as well as these and other objects, according to the present invention are attained by providing a furniture hinge according to claim 1.

Furthermore, other characteristics according to the present invention are defined in the subsequent claims.

Further characteristics and advantages of the invention shall be clearer from the description of a preferred but not exclusive embodiment of the furniture hinge according to the finding, illustrated for indicative and non-limiting purposes in the attached drawings.

BRIEF DESCRIPTION OF THE DRAWINGS

FIG. 1 shows a side view of the first equaliser of a hinge according to the known art;

FIG. 2 shows a longitudinal section of a hinge according to a first preferred embodiment of the invention, wherein the first equaliser is illustrated at the open and closure position of the door;

FIG. 3 shows a side view of the first equaliser of the hinge of FIG. 2;

FIG. 4 shows a partial longitudinal section of a second preferred embodiment of the first equaliser of a hinge according to the present invention;

DETAILED DESCRIPTION OF THE INVENTION

Figure 6:
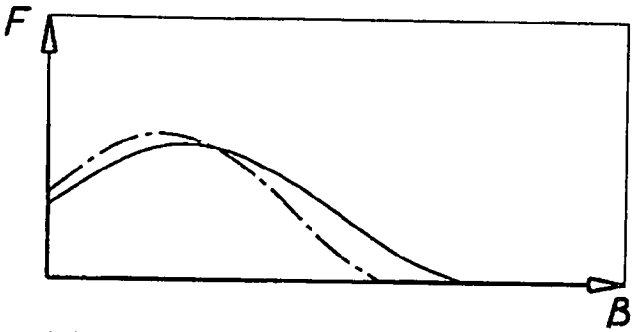
FIG. 6 shows a diagram representing the opening force of the door depending on the opening angle both for the hinge of FIG. 2 according to the present invention, and a hinge having the first equaliser as represented in FIG. 1 (obtained from the known art) replacing the first equaliser as represented in FIG. 3.

Referring to the abovementioned figures, shown is a furniture hinge, indicated in its entirety with reference number 1. The hinge 1 comprises a first equaliser 2 and a second equaliser 3 connecting, operatively to each other, the box-shaped body 4 adapted to be fixed to a door 5 of the furniture and a hinge arm 6 adapted to be directly or indirectly fixed to a fixed element 7 of the furniture.

The first equaliser 2 is pivoted to the box-shaped body 4 through a first pin 8 and to the hinge arm 6 through a second pin 9 parallel to the first pin 8.

The second equaliser 3 is pivoted to the box-shaped body 4 through a third pin 10 parallel to the first pin 8 and to the hinge arm 6 through a fourth pin 11 parallel to the first pin 8.

The structure made up of the box-shaped body 4 and the hinge arm 6 operatively connected by the equalisers 2 and 3 through pins 8,9,10, and 11 forms an articulated quadrilateral.

A flexure spring 12 is provided for the return of the door 5 during the rotation of the hinge 1.

The spring 12, in the final door closure phase, allows creating a restoring force on the door for a spontaneous and accurate closure thereof.

The flexure spring 12 is wound around a pin fixed to the hinge arm 6, in particular to the fourth pin 11, and it has a first spring arm 13 abutting against a hinge arm 6 and second spring arm 14 abutting against a control cam 15 present on the first equaliser 2.

According to an advantageous aspect of the invention, the hinge 1 has a contact surface 16 between the control cam 15 and the second spring arm 14 which, during the rotation of the hinge 1, moves both along the profile of the control cam 15 and along the profile of the second spring arm 14.

More precisely, the contact surface 16, during the rotation of the hinge 1, slides along the profile 17 of the control cam 15 and along a rectilinear section 20 of the profile of the second arm 14 of the flexure spring 12.

The control cam 15 has a curvilinear profile 17 having a curvature centre 18 positioned at a distance from the second hinging pin 9.

Preferably, the profile 17 of the control cam 15 is an arch having a constant radius of curvature 19 and a centre of curvature 18 positioned at a distance from the second hinging pin 9. The concavity of the profile 17 of the control cam 15 is faces the second hinging pin 9.

The control cam 15 is positioned proximal to the end of the first equaliser 2 pivoted to the second pin 9, and it can be made in a single piece with the first equaliser 2, as illustrated in FIG. 3, or as a separated piece associated to the first equaliser 2, as illustrated in FIG. 4.

Figure 5:
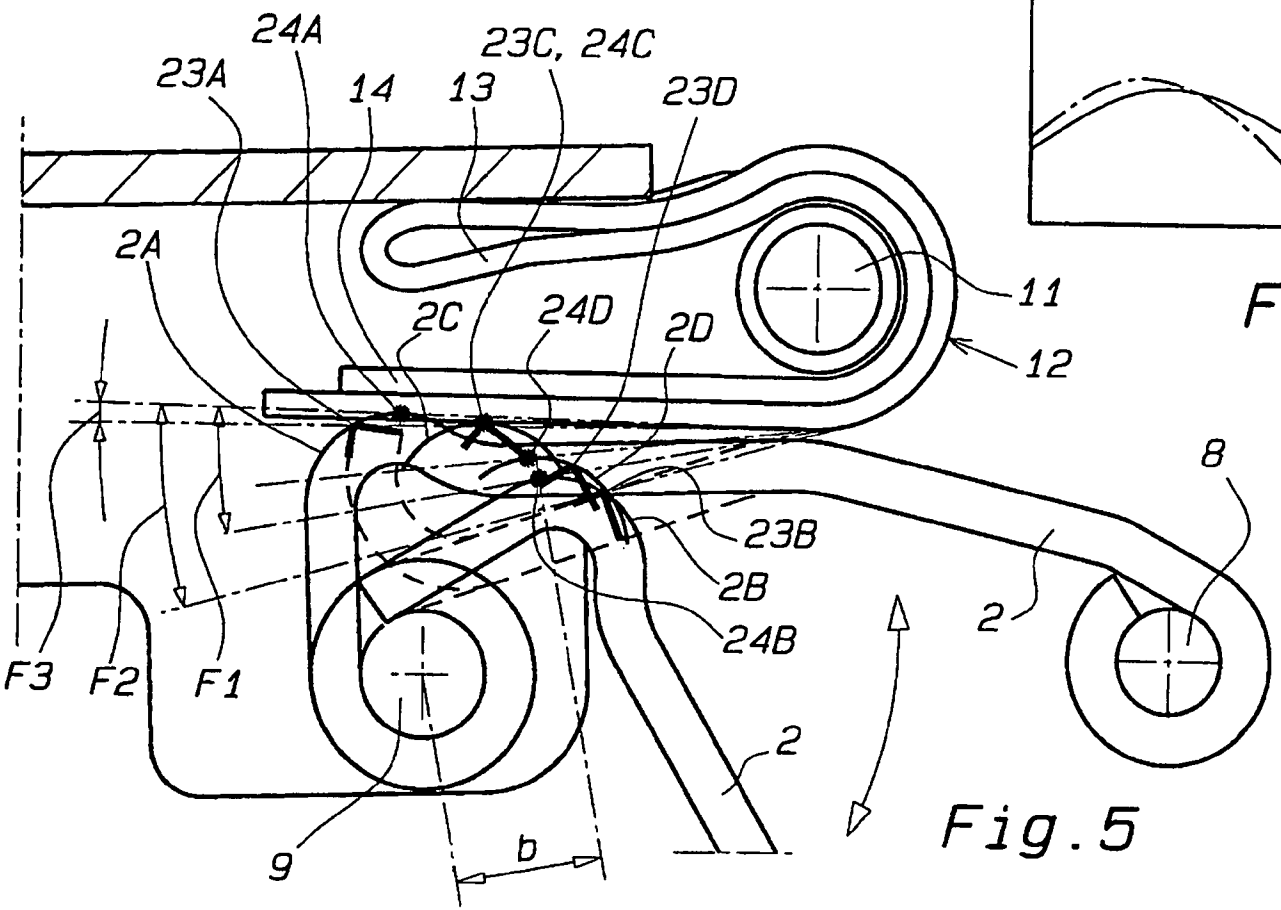
FIG. 5 shows a longitudinal section of a portion of the hinge of FIG. 2 comprising the first equaliser in opening and closure position of the door, in a reference position and in an intermediate position between the reference position and the closer position.

With reference to FIGS. 5 and 6 now examined are some parameters for comparing the hinge 1 according to the present invention and a hinge in which the first equaliser of figure is replaced by the first equaliser of FIG. 1 according to the known art.

Represented in FIG. 5 is only the apical part 21 of a control cam 22 of the first equaliser of FIG. 1 which slides with its vertex at contact with the second arm 14 of the flexure spring 12.

Now, following is a comparison of the sliding trajectory of the vertex point 23 of the apical part 21 of the control cam on the second arm 14 of the flexure spring 12 and the sliding trajectory of the control cam 15 with respect to the second arm 14 of the flexure spring 12 wherein the contact surface 16 is represented in FIG. 2 with a point 24 for simplification purposes.

In FIG. 5, 2A indicates the first equaliser in the configuration of maximum opening of the hinge 1, 2B indicates the first equaliser in the configuration of closure of the hinge 1, 2C is the first equaliser in the intermediate reference configuration of the hinge 1 wherein the position of point 23 and point 24 coincide, 2D is the first equaliser in a configuration of the hinge 1 intermediate between configuration B and C.

In FIG. 5, 23A, 23B, 23C and 23D are used to indicate the position of point 23 in configuration A, B, C and D respectively; analogously, 24A, 24B, 24C and 24D respectively indicate the position of point 24 in configuration A, B, C and D respectively.

In FIG. 5, F1 is used to indicate the closure camber to which the second arm 14 of the flexure spring 12 is subjected actuated by the control cam 15 to close the hinge, F2 is used to indicate the closure camber to which the second arm 14 of the flexure spring 12 is subjected actuated by the control cam 22 to close the hinge and F3 is used to indicate the closure camber to which the second arm 14 of the flexure spring 12 is subjected ton actuated by the control cam 22 for the maximum opening of the hinge, the opening camber to which the second arm 14 of the flexure spring 12 actuated by the control cam 15, to open the hinge, not being indicated in that, as observed hereinafter, it is almost totally absent.

In FIG. 5, it is clear that if from the reference configuration C, wherein points 23C and 24C coincide, the hinge is rotated to open, the contact point 23 moves towards the end of the second arm 14 of the flexure spring 12 exceeding the forward movement of point 24 and—on the contrary—if from the reference configuration C, wherein points 23C and 24C coincide, the hinge is rotated to close, contact point 23 moves away from the end of the second arm 14 of the flexure spring 12 exceeding the diverging movement of contact point 24.

In particular, in the opening configuration A, the attained contact point 23A is at a position most proximal to the end of the second arm 14 of the flexure spring 12 with respect to contact point 24A and this causes, for the second arm 14 of the flexure spring 12 actuated by the control cam 22, a greater relaxation giving forth to a noticeable opening camber F3 with respect to the almost absent opening camber of the second arm 14 of the flexure spring 12 actuated by the control cam 15.

In the same manner, in configuration D, the attained contact point 23D is at a more distant position from the end of the second arm 14 of the flexure spring 12 with respect to the contact point 24D and, even in a more accentuated manner, in the closure configuration B the attained contact point 23B is at a more distant position from the end of the second arm 14 of the flexure spring 12 with respect to the contact point 24B. This leads to a closure camber F2, for the second arm 14 of the flexure spring 12 actuated by the control cam 22, perceptibly greater than the closure camber F1, for the second arm 14 of the flexure spring 12 actuated by the control cam 15.

The description provided above derives from the fact that while contact point 23 moves along a circumference arc 30 with a constant radius centred on the axis 31 of the second pin 9, contact point 24 has a more limited movement deriving from its movement along a circumference arc 17 having a constant radius whose centre 18 in turn rotates with respect to the axis 31 of the second pin 9.

The dashed-dotted line of FIG. 6, representing—for the hinge provided with the first equaliser having a control cam 22—the opening force F of the hinge depending on the opening angle β, shows an opening force with an intensity maintained high, at least during the initial opening phase, and with a high maximum intensity and with application on a small opening angle.

The continuous line of FIG. 6, which represents—for the hinge provided with the first equaliser with a control cam 15—the opening force of the hinge depending on the opening angle, shows an opening force with an intensity maintained lower with respect to the preceding case, at least during the initial opening phase, with lower maximum intensity, and with application on a wider opening angle.

Alongside the lower width of the arm b corresponding to the distance of the line of action of the force of the spring from the rotation axis of the first equaliser with a control cam 15, with respect to the corresponding width of the arm, and of the first equaliser with a control cam 22, this is also due to the fact that the camber of the spring has a smaller width and hence this can provide a more constant thrust force. Furthermore, while the control cam 22 has a point contact through its sharp edge with the second arm 14 of the flexure spring 12, the control cam 15 has a extended contact on a surface with the second arm 14 of the flexure spring 12.

The above necessarily leads to a longer duration of the flexure spring 14 actuated by the control cam 15 in that subjected to a simple mechanical fatigue with a lower camber with respect to the fatigue alternated with greater camber generated during the an opening and subsequent closure cycle of the hinge with the equaliser according to the known art.

Other advantages correlated to the use of the hinge according to the present invention are even clearer in cases where the hinge has an integrated device for its deceleration under mechanical or viscous effect or a combination of both.

In such case, the hinge ensures that—during the door closure movement—the angle corresponding to the actuation of the deceleration device be re-comprised in the working angle of the flexure spring 14 in such a manner to avoid the occurrence of a stalemate condition in which the flexure spring yet does not exert a sufficient closure force, while the deceleration device is already operating.

During the opening of the door, the hinge—on the contrary—prevents jamming due to the amassing of the resistant action of the flexure spring and the deceleration device.

The device thus conceived is susceptible to various modifications and variants, all falling within the scope of the inventive concept; furthermore, all details can be replaced by technically equivalent elements.

In practice, the material used, as well as the dimensions, may vary depending on the requirements and the state of the art.

The invention claimed is:

1. Furniture hinge of the type comprising a first and a second equalizers connecting, operatively to each other, a box-shaped body adapted to be fixed to a door of said furniture and a hinge arm adapted to be directly or indirectly fixed to a fixed element of said furniture, said first equalizers being pivoted to said box-shaped body through a first pin and to said hinge arm through a second pin parallel to said first pin, said second equalizer being pivoted to said box-shaped body through a third pin and to said hinge arm through a fourth pin, a flexure spring for restoring said door during the rotation of said hinge, said flexure spring being wound around a pin fixed to said hinge arm and having a first arm abutting against said hinge arm and a second arm abutting against a control cam present on said first equalizers, wherein said hinge has a contact surface between said control cam and said second arm of said spring which, during said rotation, moves along both the profile of said control cam and along the profile of said second arm of said spring, and in that said control cam has a curvilinear profile having a centre of curvature positioned at a distance from said second pin, said curvilinear profile being arched and having a constant radius of curvature that is smaller than the distance between said contact surface and the centre of oscillation of said first equalizer about said second pin.

2. Furniture hinge according to claim 1, wherein said contact surface is between the profile of said control cam and a rectilinear section of the profile of said second arm.

3. Furniture hinge according to claim 1, characterised in that said control cam is proximal to the end of said first equalizer pivoted to said second pin.

4. Furniture hinge according to claim 1, wherein said control cam is made in a single piece with said first equalizer.

5. Furniture hinge according to claim 1, wherein said control cam is made in a piece associated to said first equalizer.

6. Furniture hinge according to claim 1, wherein said hinge has a device for decelerating its rotation.

7. Furniture hinge according to claim 1, wherein said second arm of said flexure spring, actuated by said control arm, has a negligible opening camber during opening movement of the hinge and a reduced closure camber during closing movement of the hinge.

* * * * *